US006308032B1

(12) United States Patent
Weber et al.

(10) Patent No.: US 6,308,032 B1
(45) Date of Patent: Oct. 23, 2001

(54) ROTATABLE CHARGING APPARATUS, AND PRINTING MACHINE INCLUDING THE SAME

(75) Inventors: Scott D. Weber, Canandaigua; Kenneth W. Pietrowski, Penfield; Joseph D. LaRussa, Rochester; John S. Facci, Webster; Heiko Rommelmann, Penfield; Alberto Rodriguez, Webster; Christopher Snelling, Rochester, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/664,012

(22) Filed: Sep. 19, 2000

(51) Int. Cl.[7] ..... G03G 15/02
(52) U.S. Cl. ..... 399/168; 250/325; 250/494.1
(58) Field of Search ..... 399/115, 121, 399/159, 168, 171, 297; 250/324, 325, 326, 493.1, 494.1

(56) References Cited

U.S. PATENT DOCUMENTS

| | | | | |
|---|---|---|---|---|
| 4,056,723 | | 11/1977 | Springett et al. | 250/324 |
| 4,734,722 | | 3/1988 | Maczuszenko et al. | 346/159 |
| 5,530,526 | * | 6/1996 | Kleckner et al. | 399/171 X |
| 5,563,688 | | 10/1996 | Bergen et al. | 355/219 |
| 6,210,848 | * | 4/2001 | Nagai et al. | 399/159 X |

* cited by examiner

*Primary Examiner*—Arthur T. Grimley
*Assistant Examiner*—Hoan Tran
(74) *Attorney, Agent, or Firm*—Wayne J. Egan

(57) ABSTRACT

A rotatable charging apparatus includes a length extending between a first end and a second end, with the rotatable charging apparatus centered about an axis parallel to the length. The rotatable charging apparatus outer periphery forms N apparatus positions. One charging device is fixed to each of N−1 apparatus positions. The remaining (Nth) apparatus position is devoid of a charging device, thus forming an "empty" charging device position. A host printing machine selectively causes the rotatable charging apparatus to rotate about its axis thereby selectively position any of its N−1 charging devices to face a proximately-located photosensitive element. When a problem exists with the current charging device, or when the total number of operating hours of the current charging device exceeds a fixed threshold, the printing machine causes the rotatable charging apparatus to rotate from its current charging device to position a new charging device facing the photosensitive element. Also, the printing machine causes the rotatable charging apparatus to rotate from its current charging device to the empty charging device position facing the photosensitive element when a power-down or hard-stop condition exists in the printing machine.

14 Claims, 8 Drawing Sheets

ROTATABLE CHARGING APPARATUS, AND PRINTING MACHINE INCLUDING THE SAME

INCORPORATION BY REFERENCE OF ANOTHER U.S. PATENT

The applicant hereby incorporates by reference the disclosure of Richard F. Bergen et al., U.S. Pat. No. 5,563,688, "Charging device for charging in one of a plurality of predefined image areas on a surface of an imaging member," issued Oct. 8, 1996, verbatim and with the same effect as though such disclosure were fully and completely set forth herein.

FIELD OF THE INVENTION

This application relates to xerography including, but not limited to, rotatable charging apparatus.

BACKGROUND OF THE INVENTION

Current xerographic printing machines use charging devices in the charging, recharging, pre-transfer, transfer, de-tack and pre-clean stations. Charging devices comprise several types, including glass-coated alternating-current wire scorotrons, also known as discorotrons, and solid-state devices, also known as "microtrons".

These two devices, discorotrons and solid-state chargers, each provide substantially different operating characteristics. For example, while the operating-life of a discorotron is substantial, the discorotron generates a substantial amount of undesirable gaseous emissions such as, for example, ozone. In contrast, while a solid-state charger has a relatively short life, the solid-state charger produces only a fraction of the ozone of the equivalent discorotron. For example, in a preliminary experiment, a solid-state charger emitted only about one-seventh (1/7) of the ozone emitted by the equivalent discorotron.

What is needed, therefore, is an improved charging apparatus that generates acceptable amounts of undesirable ozone gas while still providing a satisfactory operating life.

SUMMARY OF THE INVENTION

In one aspect of the invention, a rotatable charging apparatus comprises an apparatus length extending between a first end and a second end and centered about an axis parallel to the apparatus length, with plural charging devices fixed to an apparatus periphery surrounding the axis, the rotatable charging apparatus rotatable about the axis to thereby selectively position any charging device to face a proximate photosensitive element.

In another aspect of the invention, a printing machine comprises rotatable charging apparatus, the rotatable charging apparatus comprising an apparatus length extending between a first end and a second end and centered about an axis parallel to the apparatus length, with plural charging devices fixed to an apparatus periphery surrounding the axis, the rotatable charging apparatus rotatable about the axis to thereby selectively position any charging device to face a proximate photosensitive element.

DESCRIPTION OF THE PREFERRED EMBODIMENTS

Briefly, a rotatable charging apparatus comprises a length extending between a first end and a second end, with the rotatable charging apparatus centered about an axis parallel to the length. The rotatable charging apparatus outer periphery forms N apparatus positions. One charging device is fixed to each of N−1 apparatus positions. The remaining (Nth) apparatus position is devoid of a charging device, thus forming an "empty" charging device position. A host printing machine selectively causes the rotatable charging apparatus to rotate about its axis to thereby selectively position any of its N−1 charging devices to face a proximately-located photosensitive element. When a problem exists with the current charging device, or when the total number of operating hours of the current charging device exceeds a fixed threshold, the printing machine causes the rotatable charging apparatus to rotate from its current charging device to position a new charging device facing the photosensitive element. The displaced charging device is de-energized and the new device facing the photosensitive element is energized. Also, the printing machine causes the rotatable charging apparatus to rotate from its current charging device to the empty charging device position facing the photosensitive element when a power-down or hard-stop condition exists in the printing machine.

Figure 1:
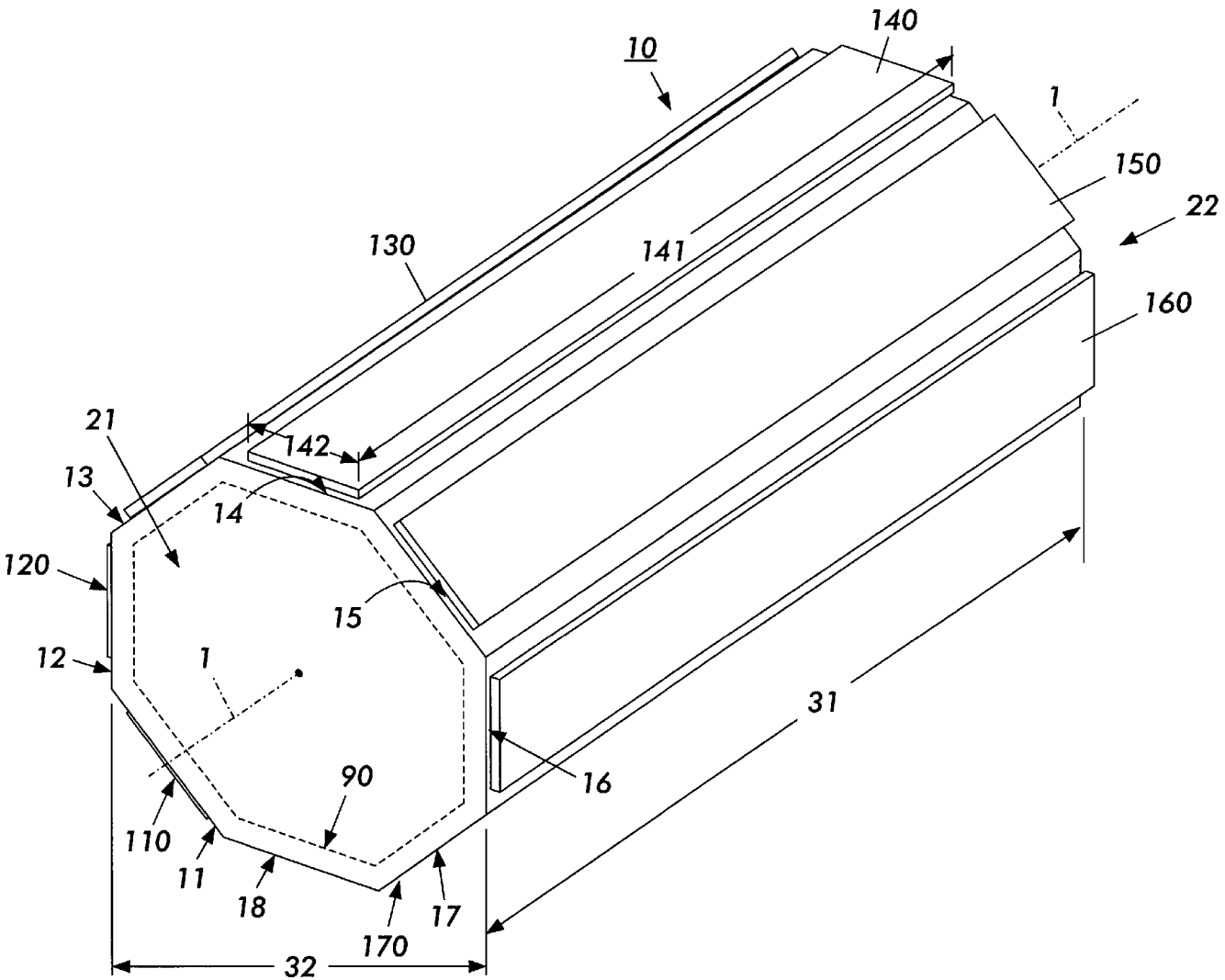
FIG. 1 is an elevated perspective view of a first embodiment of a rotatable charging apparatus 10, in accordance with the present invention.

Referring now to FIG. 1, there is shown a first embodiment of a rotatable charging apparatus 10, in accordance with the present invention.

As shown in FIG. 1, the rotatable charging apparatus 10 comprises an apparatus length 31 extending between a first end 21 and a second end 22 and centered about an axis 1 parallel to the apparatus length 31. As shown, the rotatable charging apparatus 10 comprises a plurality of charging devices generally designated by reference numerals 110–170 fixed to an apparatus periphery 90 surrounding the axis 1.

Figure 2:
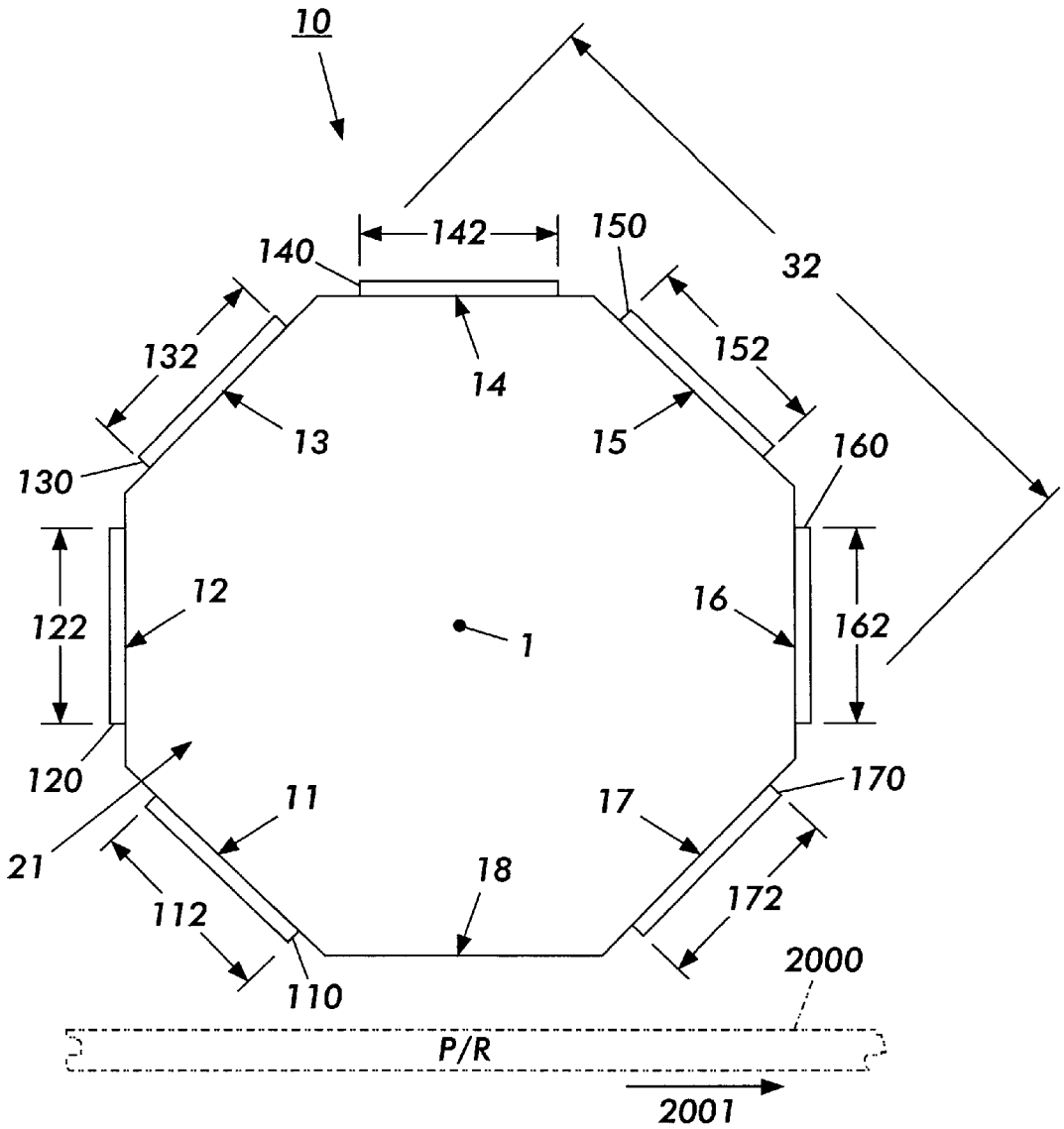
FIG. 2 is a side view of the rotatable charging apparatus 10 positioned so that apparatus surface 18 which is devoid of a charging device, thus forming an "empty" charging device position 18, faces a proximate photosensitive element 2000.

Referring now to FIG. 2, as depicted therein, the rotatable charging apparatus 10 is arranged to rotate about the axis 1 to thereby selectively position any charging device of the plurality of charging devices 110–170 to face a proximate photosensitive element 2000. In one embodiment, for example, the photosensitive element 2000 comprises a photoreceptor belt moving in a process direction 2001, as depicted in FIG. 2. Those skilled in the art will know that, in another embodiment, the photosensitive element 2000 may comprise a photoreceptor drum.

In one embodiment, each of the charging devices 110–170 comprises a solid-state charger, also known as a "microtron".

In one embodiment, each of the charging devices 110–170 is similar to the solid-state charger disclosed in the aforementioned U.S. Pat. No. 5,563,688.

In another embodiment, each of the charging devices 110–170 is similar to the solid-state charger disclosed in the publication of Yasuo Hosaka and Hideyuki Nakoa, "Small-size and less-ozone-emitting solid-state charger for printers or copy machines," IS&T's NIP 12: International Conference on Digital Printing Technologies, Oct. 27 through Nov. 1, 1996, San Antonio, Tex., pages 339 through 342, the disclosure of which publication is hereby incorporated by reference.

It will be appreciated that, in still further embodiments, each of the charging devices 110–170 comprises a still further type of charging device, which type of charging device generates only acceptable amounts of undesirable gaseous emissions including, without limitation, ozone.

Referring again to FIG. 1, as depicted therein, the apparatus periphery 90 comprises a plurality of apparatus surfaces 11–18. It will be understood that each apparatus surface 11–18 forms a corresponding charging device position. As shown, each charging device of the plural charging devices 110–170 is fixed to an apparatus surface of the plural apparatus surfaces 11–18.

Figure 3:
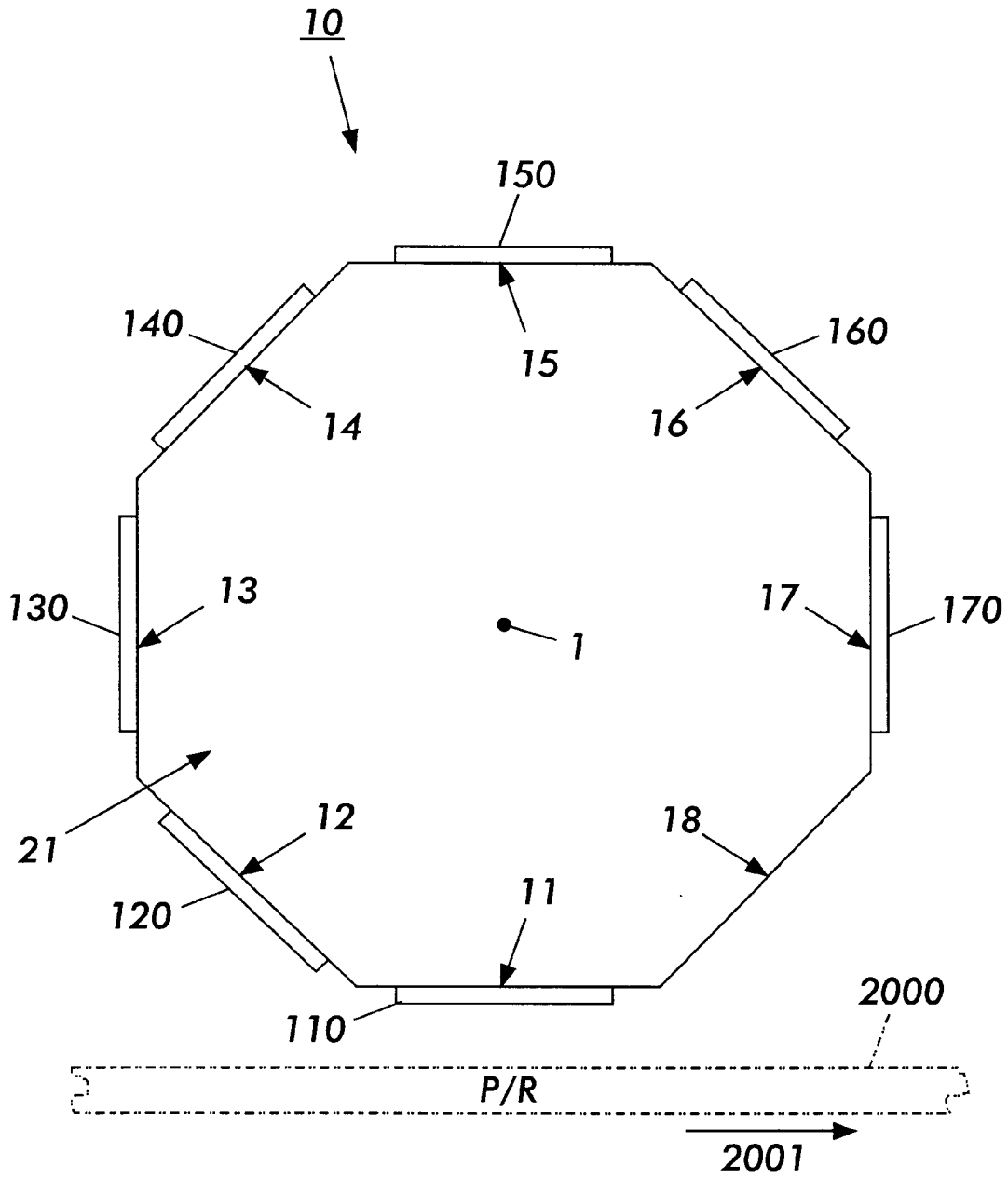
FIG. 3 is a side view of the rotatable charging apparatus 10 positioned so that charging device 110 mounted on apparatus surface 11 faces the proximate photosensitive element 2000.

Referring generally to FIGS. 1–3, in one embodiment, the first end 21 and the second end 22 of the rotatable charging apparatus 10 respectively form first and second polygons. Each of the first and second polygons 21–22 comprise a fixed number ("N") of sides. In one embodiment, for example, and as particularly depicted in FIGS. 1–3, the rotatable charging apparatus 10 is arranged so that the value of N, the fixed number of end polygon sides, is 8.

Assuming, as depicted in FIGS. 1–3, that N equals 8, in one embodiment, the rotatable charging apparatus 10 has an apparatus width 32 of about 12 mm, with each of the plurality of charging devices 110–170 comprising a charging device width 112–172 of about 5 mm. Still assuming that N equals 8, in a further embodiment, the charging device 10 apparatus width 32 is about 16.8 mm, with each charging device of the plurality of charging devices 110–170 comprising a charging device width 112–172 of about 7 mm.

As depicted in FIGS. 1–3, each of the charging devices 110–170 further comprises a charging device thickness of about 1–5 mm and a charging device length about equal to the surface width of the photosensitive element 2000. (The photosensitive element 2000 is depicted in FIGS. 2–3.)

In contrast to the aforementioned embodiment of FIGS. 1–3, however, it will be appreciated that, in still further embodiments, N has a value different than 8. In these latter embodiments, for example, N has a value below 8 (such as 7, 6, 5, etc.) or above 8 (such as 9, 10, 11, 12, etc.).

As depicted in FIGS. 2–3, in one embodiment, the rotatable charging apparatus 10 is arranged so that at least one apparatus surface of the plurality of apparatus surfaces 11–18 is devoid of a charging device, thus forming an "empty" charging device position. In one embodiment, for example, and as depicted in FIGS. 2–3, a single apparatus surface 18 is devoid of a charging device, thus forming an empty charging device position 18.

In contrast to the aforementioned embodiment of FIGS. 2–3, however, it will be appreciated that, in further embodiments, any apparatus surface of the plurality of apparatus surfaces 11–18 may be devoid of a charging device. In these latter embodiments, for example, the apparatus surface 11, 12 or 13, etc., is devoid of a charging device.

In further contrast to the aforementioned embodiment of FIGS. 2–3, however, it will be appreciated that, in still further embodiments, more than one apparatus surfaces of the plurality of apparatus surfaces 11–18 are devoid of a charging device. In these latter embodiments, for example, two, three, four, or any greater number of the plural apparatus surfaces 11–17 are devoid of a charging device.

Also, it will be understood that a set of apparatus surfaces devoid of charging devices may comprise member apparatus surfaces of any of the plural apparatus surfaces 11–18. Thus, for example, a set of two (2) apparatus surfaces devoid of charging devices may comprise member apparatus surfaces 11 and 12; 11 and 13; 11 and 14; 11 and 15; 11 and 16; 11 and 17; or other combination of surfaces.

Figure 4:
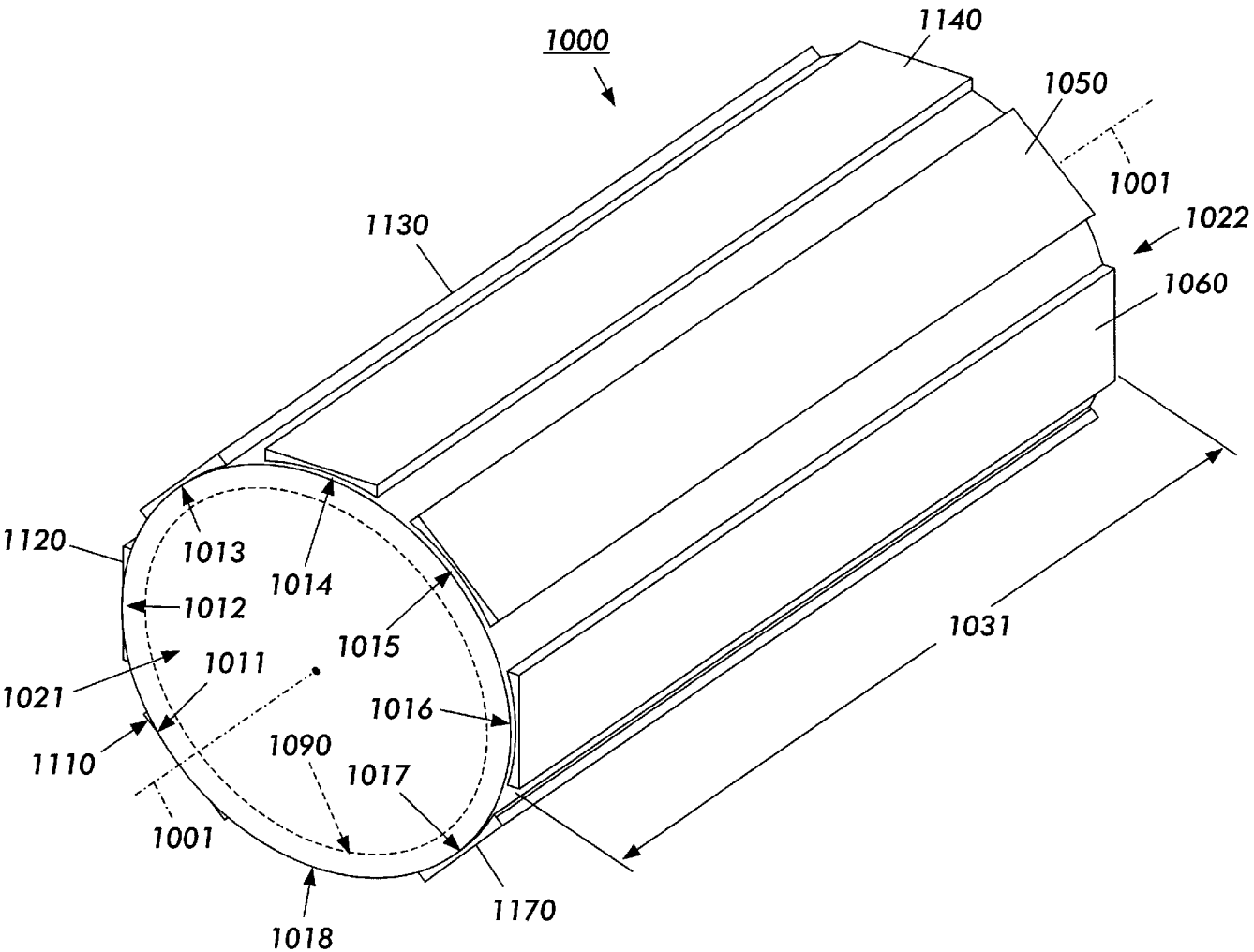
FIG. 4 is an elevated perspective view of a second embodiment of a rotatable charging apparatus 1000, in accordance with the present invention.

Referring now to FIG. 4, there is shown a second embodiment of a rotatable charging apparatus 1000, in accordance with the present invention.

As shown in FIG. 4, the rotatable charging apparatus 1000 comprises an apparatus length 1031 extending between a first end 1021 and a second end 1022 and centered about an axis 1001 parallel to the apparatus length 1031. As shown, the rotatable charging apparatus 1000 comprises a plurality of charging devices generally designated by reference numerals 1110–1170 fixed to an apparatus periphery 1090 surrounding the axis 1001.

Figure 5:
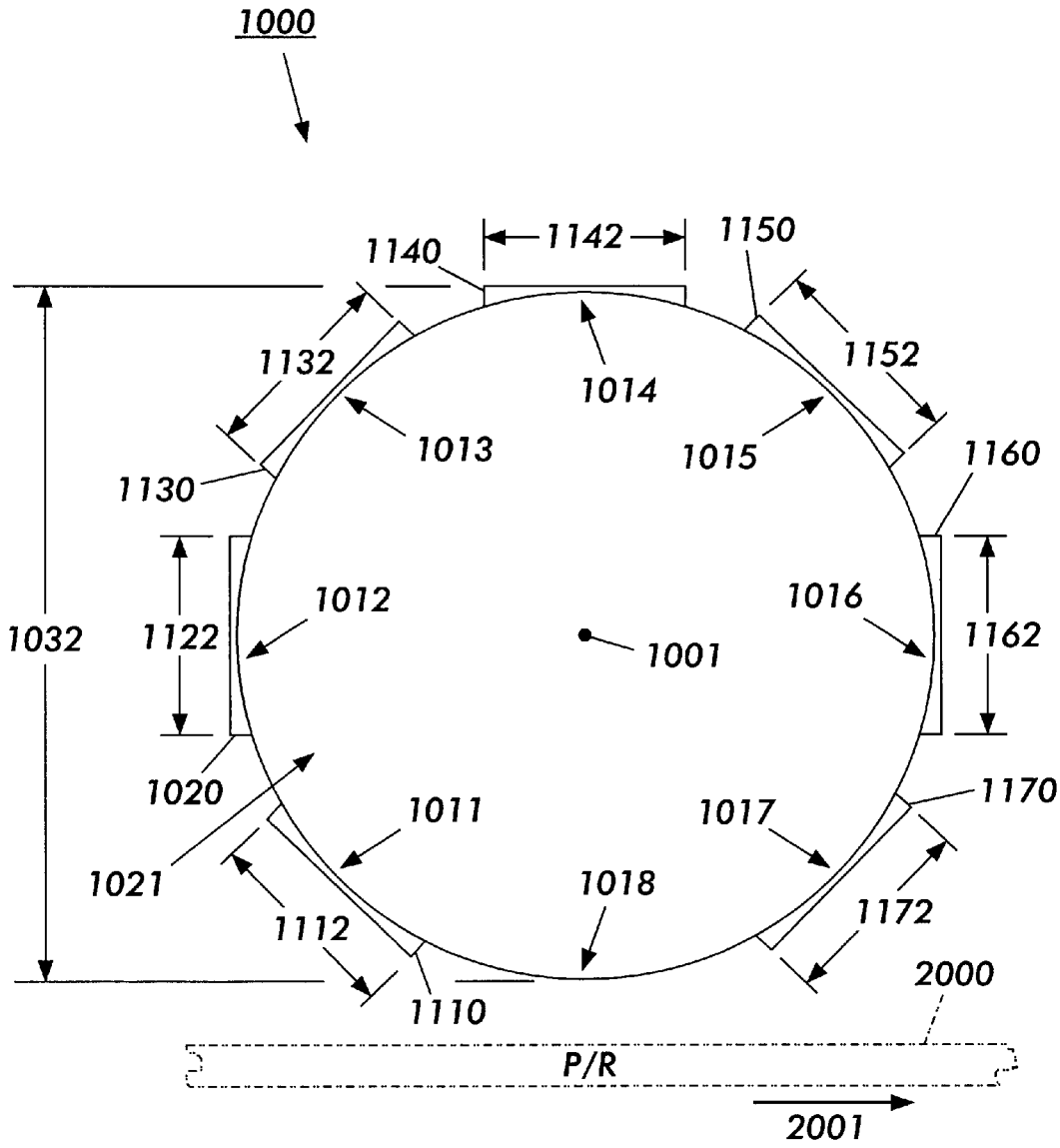
FIG. 5 is a side view of the rotatable charging apparatus 1000 positioned so that apparatus position 1018 which is devoid of a charging device, thus forming an "empty" charging device position 1018, faces a proximate photosensitive element 2000.

As shown in FIG. 5, the rotatable charging apparatus 1000 is arranged to rotate about the axis 1001 to thereby selectively position any charging device of the plurality of charging devices 1110–1170 to face a proximate photosensitive element 2000. In one embodiment, for example, the photosensitive element 2000 comprises a photoreceptor belt moving in a process direction 2001, as depicted in FIG. 5. Those skilled in the art will know that, in another embodiment, the photosensitive element 2000 may comprise a photoreceptor drum.

In one embodiment, each of the charging devices 1110–1170 comprises a solid-state charger, or microtron.

In one embodiment, each of the charging devices 1110–1170 is similar to the solid-state charger of the above U.S. Pat. No. 5,563,688.

In another embodiment, each of the charging devices 1110–1170 is based on the above publication of Yasuo Hosaka and Hideyuki Nakoa.

It will be appreciated that, in still further embodiments, each of the charging devices 1110–1170 comprises a still further type of charging device, which type of charging device generates only acceptable amounts of undesirable gaseous emissions including, without limitation, ozone.

Referring again to FIG. 4, as depicted therein, the apparatus periphery 1090 comprises a plurality of apparatus positions 1011–1018. As shown, each charging device of the plural charging devices 1110–1170 is fixed to an apparatus position of the plural apparatus positions 1011–1018.

Figure 6:
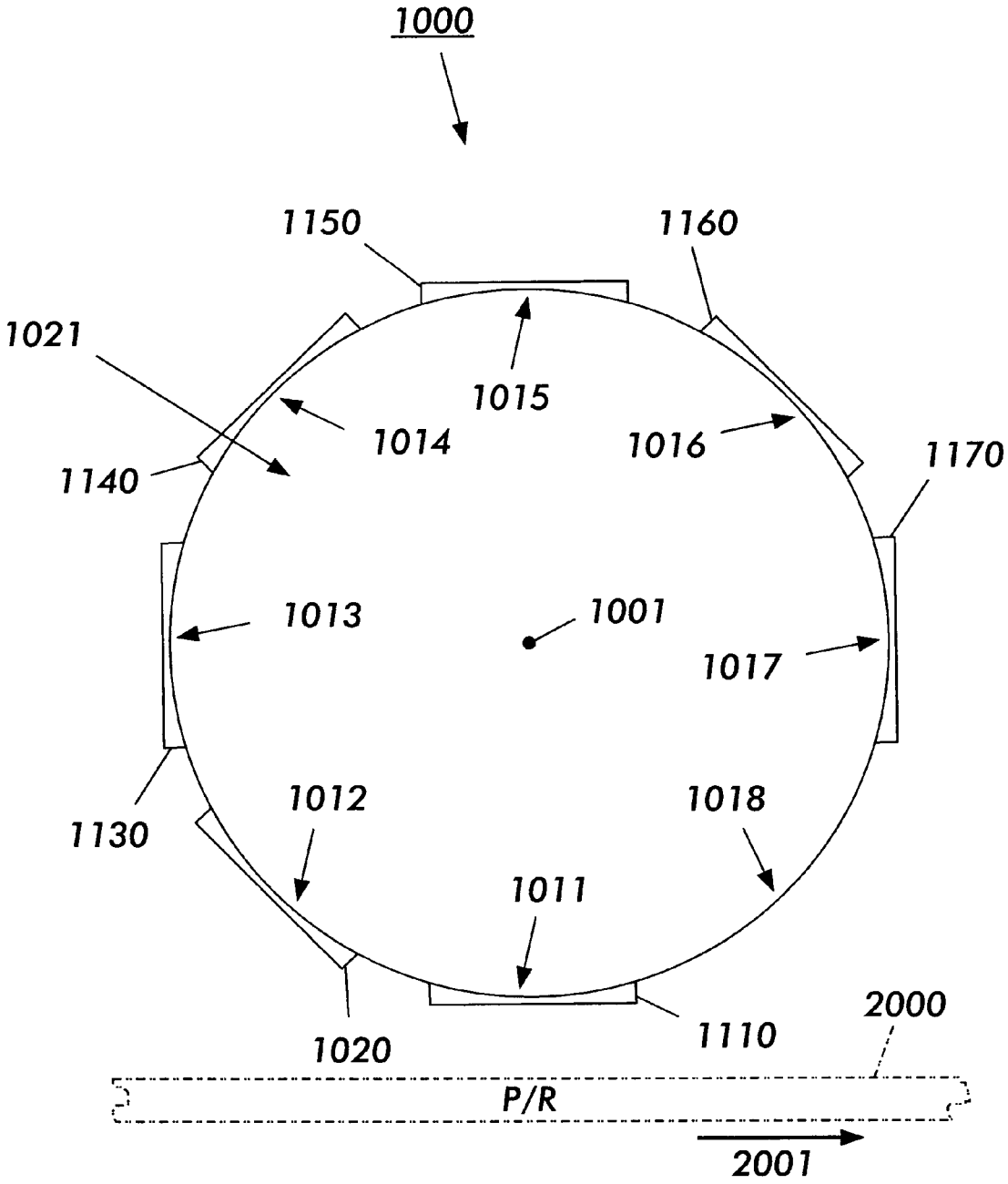
FIG. 6 is a side view of the rotatable charging apparatus 1000 positioned so that charging device 1110 mounted at apparatus position 1011 faces the proximate photosensitive element 2000.

Referring to FIGS. 4–6, in one embodiment, the first end 1021 and the second end 1022 of the rotatable charging apparatus 1000 generally are circular-shaped. The apparatus periphery 1090 comprises a fixed number ("N") of apparatus positions. In one embodiment, for example, and as particularly depicted in FIGS. 4–6, the rotatable charging apparatus 1000 is arranged so that the value of N, the fixed number of apparatus positions, is 8.

Assuming, as depicted in FIGS. 4–6, that N equals 8, in one embodiment, the rotatable charging apparatus 1000 has an apparatus width 1032 of about 12 mm, with each of the plurality of charging devices 1110–1170 comprising a charging device width 1112–1172 of about 5 mm. Still assuming that N equals 8, in a further embodiment, the charging device 1010 apparatus width 1032 is about 16.8 mm, with each charging device of the plurality of charging devices 1110–1170 comprising a charging device width 1112–1172 of about 7 mm.

As depicted in FIG. 4, each of the charging devices 1110–1170 further comprises a charging device thickness of about 1–5 mm and a charging device length about equal to the surface width of the photosensitive element 2000.

In contrast to the aforementioned embodiment of FIGS. 4–6, however, it will be appreciated that, in still further embodiments, N is a value different than 8. In these latter embodiments, for example, N has a value below 8 (such as 7, 6, 5, etc.) or above 8 (such as 9, 10, 11, 12, etc.).

As depicted in FIGS. 5–6, in one embodiment, the rotatable charging apparatus 1000 is arranged so that at least one apparatus position of the plurality of apparatus positions 1011–1018 is devoid of a charging device, thus forming an "empty" charging device position. In one embodiment, for example, and as depicted in FIGS. 5–6, a single apparatus position 1018 is devoid of a charging device, thus forming an empty charging position 1018.

In contrast to this aforementioned embodiment of FIGS. 5–6, however, it will be appreciated that, in still further embodiments, any apparatus position of the plurality of apparatus positions 1011–1018 may be devoid of a charging device. In these latter embodiments, for example, the apparatus position 1011, 1012 or 1013, etc., is devoid of a charging device.

In further contrast to the aforementioned embodiment of FIGS. 5–6, however, it will be appreciated that, in still further embodiments, more than one apparatus positions of the plurality of apparatus positions 1011–1018 are devoid of a charging device. In these latter embodiments, for example, two, three, four, or any greater number of apparatus positions of the plurality of apparatus positions 1011–1018 are devoid of a charging device.

Also, it will be understood that a set of apparatus positions devoid of charging devices may comprise member apparatus positions of any of the plural apparatus positions 1011–1018. Thus, for example, a set of two (2) apparatus positions devoid of charging devices may comprise member apparatus positions 1011 and 1012; 1011 and 1013; 1011 and 1014; 1011 and 1015; 1011 and 1016; 1011 and 1017; or other combination of positions.

Figure 7:
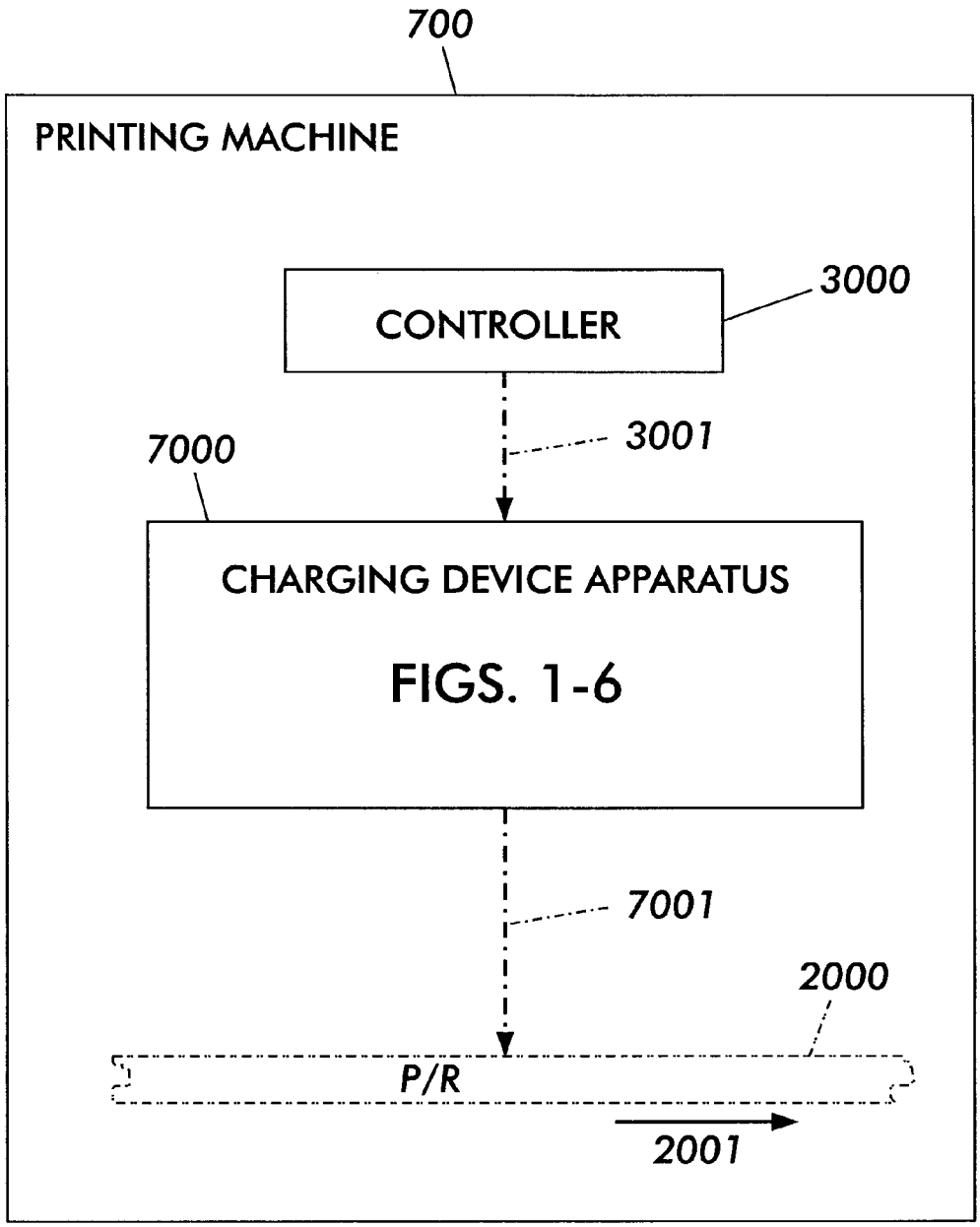
FIG. 7 is a block diagram of a printing machine 700, which printing machine comprises a rotatable charging apparatus 7000, in accordance with the present invention.

Referring now to FIG. 7 there is depicted a printing machine 700 including a rotatable charging apparatus 7000, in accordance with the present invention. In one embodiment, the rotatable charging apparatus 7000 comprises the rotatable charging apparatus 10 disclosed by FIGS. 1–3 and the foregoing written description corresponding thereto. In another embodiment, the rotatable charging apparatus 7000 comprises the rotatable charging apparatus 1000 disclosed by FIGS. 4–6 and the foregoing written description corresponding thereto.

As discussed hereinabove, one key feature of the FIG. 7 present rotatable charging apparatus 7000 (corresponding to the foregoing element 10 or element 1010) is its ability to rotate about its axis (corresponding to the foregoing element 1 or element 1001) to thereby selectively position any single charging device of its plural charging devices (corresponding to the foregoing elements 110–170 or elements 1110–1170) to face the proximately-located photosensitive element 2000 that is moving in a process direction 2001.

As shown in FIG. 7, the printing machine 700 includes a controller 3000 coupled to the rotatable charging apparatus 7000 by means of a control path 3001. The controller 3000 is arranged to selectively control the rotation of the rotatable charging apparatus 7000 and thereby, in turn, selectively position any charging device to the photoreceptor 2000. In FIG. 7, the selective positioning of a "current" charging device to the photoreceptor 2000 is depicted by the numeral 7001.

In one embodiment, the controller 3000 comprises a suitably-programmed processor or the like.

Figure 8:
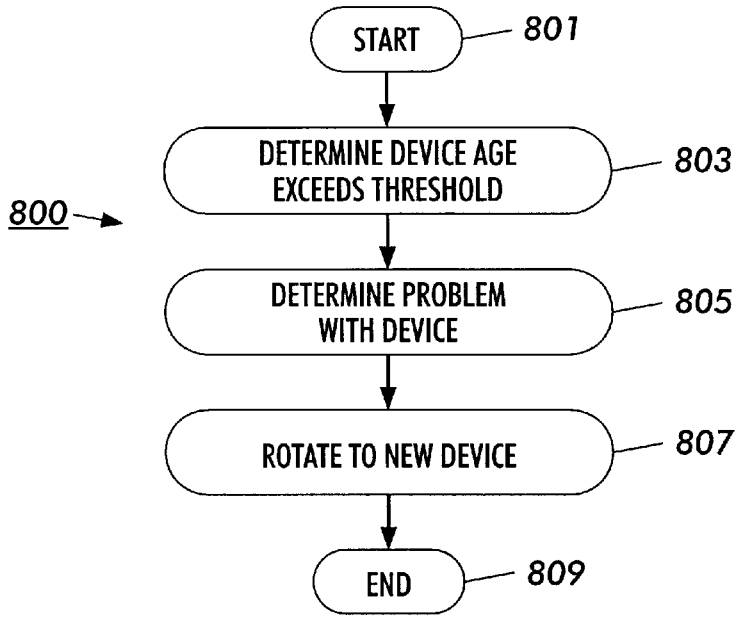
FIG. 8 is a first flow diagram for the printing machine 700 of FIG. 7.

In one embodiment, the controller 3000 is arranged to control the rotatable charging apparatus 7000 in accordance with a first process 800 depicted in FIG. 8.

Referring now to FIG. 8, as depicted therein, the process starts at step 801, and then proceeds to step 803.

In step 803, the process determines when the "age" of the charging device that is currently facing the photoreceptor 2000, known as the "current charging device", exceeds a fixed threshold. In one embodiment, the current charging device age is determined based on the total number of hours of operation of the current charging device. When step 803 determines that the age of the current charging device exceeds the fixed threshold, the process goes to step 807. Otherwise, after step 803, the process goes to step 805.

In step 805, the process determines when a problem exists with the current charging device. In one embodiment, a "problem" is defined as premature charging device failure, or massive dirt contamination, or non-uniform charging conditions. When step 805 determines that a problem exists with the current charging device, the process goes to step 807. Otherwise, after step 805, the process goes to step 809.

In step 807, the process rotates the rotatable charging apparatus 7000 from its current charging device to a new charging device facing the photosensitive element 2000. After step 807, the process goes to step 809.

At step 809, the process ends.

Returning again to FIG. 7, it will be understood that the rotatable charging apparatus 7000 (corresponding to either element 10 or 1010) includes at least one empty charging device position. This is summarized as follows. In the rotatable charging apparatus 10 of FIGS. 1–3, at least one apparatus surface (or position) of the plural apparatus surfaces 11–17 is devoid of a charging device, thus corresponding to at least one empty charging device position therein. Likewise, in the rotatable charging apparatus 1010 of FIGS. 4–6, at least one apparatus position of the plural apparatus positions 1011–1017 is devoid of a charging device, thus corresponding to at least one empty charging device position therein.

As a result of the rotatable charging apparatus 10 or 1010 comprising at least one empty charging device position, another key feature of the FIG. 7 rotatable charging apparatus 7000 is its ability to rotate about its axis to thereby selectively position the at least one empty charging device position to face the proximately-located photosensitive element 2000 that is moving in a process direction 2001.

Figure 9:
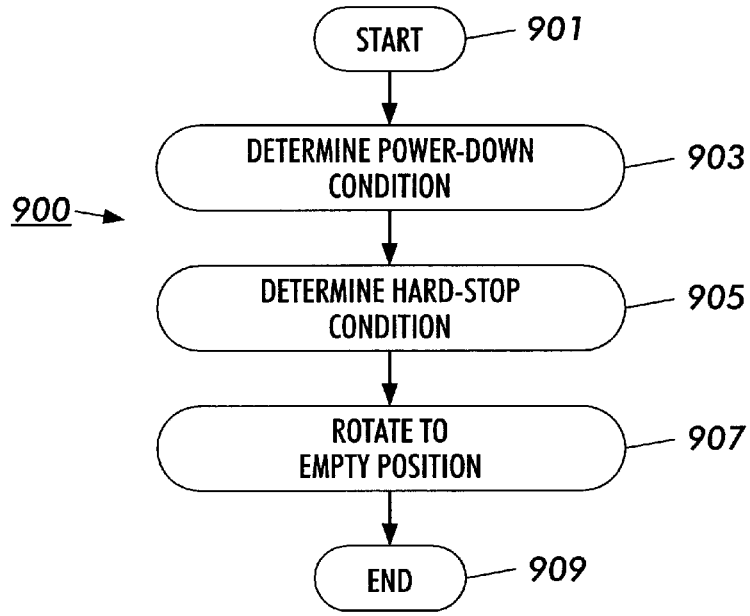
FIG. 9 is a second flow diagram for the printing machine 700 of FIG. 7.

Accordingly, in another embodiment, the controller 3000 is arranged to control the rotatable charging apparatus 7000 in accordance with a second process 900 as depicted in FIG. 9.

Referring now to FIG. 9, as depicted therein, the process starts at step 901, and then proceeds to step 903.

In step 903, the process determines when a power-down condition exists in the printing machine 700. When step 903 determines that a power-down condition exists, the process goes to step 907. Otherwise, after step 903, the process goes to step 905.

In step 905, the process determines when a hard-stop condition exists in the printing machine 700. In one embodiment, the hard-stop condition comprises a paper jam, or the like. When step 905 determines that a hard-stop condition exists, the process goes to step 907. Otherwise, after step 905, the process goes to step 909.

In step 907, the process rotates the rotatable charging apparatus from the current charging device to the at least one empty charging device position to face the photosensitive element 2000. In the rotatable charging apparatus 10 of FIGS. 1–3, this step 907 is equivalent to rotating the rotatable charging apparatus 10 to the at least one apparatus surface 18 of the plural apparatus surfaces 11–18 that is devoid of a charging device. Also, in the rotatable charging apparatus 1010 of FIGS. 4–6, this step 907 is equivalent to rotating the rotatable charging apparatus 1010 to the at least one apparatus position 1018 of the plural apparatus surfaces 1011–1018 that is devoid of a charging device. After step 907, the process goes to step 909.

In step 909, the process ends.

Still referring to the second process 900 of FIG. 9, it will be understood that, in accordance with step 903, it is desirable to rotate the rotatable charging apparatus 7000 from its current charging device to the at least one empty charging device position facing the photoreceptor 2000 during a power-down condition in the printing machine 700 to prevent Nitrous Oxide substances emitted from the current charging device from depositing on the photoreceptor 2000 and thereby damaging it. Also, it will be further understood that, in further accordance with step 903, it is further desirable to rotate the rotatable charging apparatus 7000 from the current charging device to the at least one empty charging device position facing the photoreceptor 2000 during a power-down condition in the printing machine 700 to prevent any heat emitted from the heater in the current charging device from facing the photoreceptor 2000 and thereby potentially damaging it.

Still referring to the second process 900 of FIG. 9, it will be understood that, in accordance with step 905, it is desirable to rotate the rotatable charging apparatus from the current charging device to the at least one empty charging device position facing the photoreceptor 2000 during a hard-stop condition in the printing machine 700 to prevent heat emitted by the current charging device from damaging the photoreceptor 2000 or causing the toner to start blocking and becoming sticky and hard to transfer.

In still another embodiment, the controller 3000 is arranged to control the rotatable charging apparatus 7000 in accordance with the first process 800 as depicted in FIG. 8 and also in accordance with the second process 900 as depicted in FIG. 9.

In summary, there has been disclosed rotatable charging apparatus (FIGS. 1–3 element 10 or FIGS. 4–6 element 1000) comprising an apparatus length (31 or 1031) extending between a first end (21 or 1021) and a second end (22 or 1022) and centered about an axis (1 or 1001) parallel to the apparatus length, with plural charging devices (110–170 or 1110–1170) fixed to an apparatus periphery (90 or 1090) surrounding the axis, the rotatable charging apparatus rotatable about the axis to thereby selectively position any charging device to face a proximate photosensitive element 2000.

Also, there has been disclosed a printing machine 700 comprising rotatable charging apparatus (FIGS. 1–3 element 10 or FIGS. 4–6 element 1000), the rotatable charging apparatus comprising an apparatus length (31 or 1031) extending between a first end (21 or 1021) and a second end (22 or 1022) and centered about an axis (1 or 1001) parallel to the apparatus length, with plural charging devices (110–170 or 1110–1170) fixed to an apparatus periphery (90 or 1090) surrounding the axis, the rotatable charging apparatus rotatable about the axis to thereby selectively position any charging device to face a proximate photosensitive element 2000.

As disclosed, the printing machine 700 is arranged for rotating (step 807) the rotatable charging apparatus (10 or 1000) from a current charging device to a new charging device facing the photosensitive element 2000 when a total number of hours of operation of the current charging device exceeds a fixed threshold (step 803).

Also as disclosed, the printing machine 700 is further arranged for rotating (step 807) the rotatable charging apparatus (10 or 1000) from the current charging device to the new charging device when a problem exists with the current charging device (step 805).

Also as disclosed, the printing machine 700 is further arranged for rotating (step 907) the rotatable charging apparatus (10 or 1000) from a current charging device to the at least one apparatus surface devoid of a charging device facing the photosensitive element when a power-down condition exists (step 903).

Also as disclosed, the printing machine 700 is further arranged for rotating (step 907) the rotatable charging apparatus (10 or 1000) from the current charging device to the at least one apparatus surface devoid of a charging device when a hard-stop condition exists (step 905).

Some advantages of the rotatable charging apparatus, in accordance with the present invention, are now discussed.

While the life goal for the solid-state charger may be, for example, only 300 hours, however, the present invention configures multiple solid-state charger units in the disclosed configurations of FIGS. 1–6, or equivalents thereof, to significantly increase product run times. As a result, the rotatable charging apparatus, in accordance with the present invention, presents over-all dimensions that are significantly less than the previous single equivalent discorotron unit. In one embodiment, for example, the rotatable charging apparatus, in accordance with the present invention, comprises an apparatus width (corresponding to FIGS. 1–3 element 31 and FIGS. 4–6 element 1031) of about 20 mm or less, and an apparatus length (corresponding to FIGS. 1–3 element 32 and FIGS. 4–6 element 1032) of 300 mm.

Further, the rotatable charging apparatus, in accordance with the present invention, offers good voltage-sensitive charging performance.

Moreover, the rotatable charging apparatus, in accordance with the present invention, offers lower ozone generation, extensibility across volume bands, and low audible noise.

Furthermore, the rotatable charging apparatus, in accordance with the present invention, is scalable to larger process widths.

Also, the rotatable charging apparatus, in accordance with the present invention, offers potential coronode redundancy for increased charge performance and reliability. Thus, by increasing the number of solid-state chargers available on a single rotatable charging apparatus, the time between repairs is increased. For example, based on a first assumption that the rotatable charging apparatus, in accordance with the present invention, is arranged with seven (7) solid-state chargers, and further based on a second assumption that each of the seven (7) solid-state chargers comprise a 2000-hour operating life, then the time between replacements of the rotatable charging apparatus is expected to be about 583 days. Moreover, in the aforementioned example, if each of the seven (7) solid-state chargers comprise a 300-hour operating life, then the time between replacements of the rotatable charging apparatus is expected to be about 87.5 days.

While various embodiments of a rotatable charging apparatus and printing machine including the same, in accordance with the present invention, have been described hereinabove, the scope of the invention is defined by the following claims.

What is claimed is:

1. A rotatable charging apparatus comprising an apparatus length extending between a first end and a second end and centered about an axis parallel to the apparatus length, with plural charging devices fixed to an apparatus periphery surrounding the axis, the rotatable charging apparatus rotatable about the axis to thereby selectively position any charging device to face a proximate photosensitive element, each charging device comprising a solid-state charger, the first and second ends generally being circular-shaped.

2. A rotatable charging apparatus comprising an apparatus length extending between a first end and a second end and centered about an axis parallel to the apparatus length, with plural charging devices fixed to an apparatus periphery surrounding the axis, the rotatable charging apparatus rotatable about the axis to thereby selectively position any charging device to face a proximate photosensitive element, each charging device comprising a solid-state charger, the apparatus periphery comprising plural apparatus surfaces with each charging device fixed to one of the plural apparatus surfaces, at least one apparatus surface being devoid of a charging device.

3. The rotatable charging apparatus of claim 2, the first and second ends respectively forming first and second polygons, each polygon with a fixed number ("N") of sides.

4. The rotatable charging apparatus of claim 3, N being 8.

5. The rotatable charging apparatus of claim 4, each charging device comprising a charging device width of about 5 mm.

6. The rotatable charging apparatus of claim 4, each charging device comprising a charging device width of about 7 mm.

7. A printing machine comprising a rotatable charging apparatus, the rotatable charging apparatus comprising an apparatus length extending between a first end and a second end and centered about an axis parallel to the apparatus length, with plural charging devices fixed to an apparatus periphery surrounding the axis, the rotatable charging apparatus rotatable about the axis to thereby selectively position any charging device to face a proximate photosensitive element, each charging device comprising a solid-state charger, the first and second ends generally being circular-shaped.

8. A printing machine comprising a rotatable charging apparatus, the rotatable charging apparatus comprising an apparatus length extending between a first end and a second end and centered about an axis parallel to the apparatus length, with plural charging devices fixed to an apparatus periphery surrounding the axis, the rotatable charging apparatus rotatable about the axis to thereby selectively position any charging device to face a proximate photosensitive element, each charging device comprising a solid-state charger, the apparatus periphery comprising plural apparatus surfaces with each charging device fixed to one of the plural apparatus surfaces, at least one apparatus surface being devoid of a charging device.

9. The printing machine of claim 8, the first and second ends respectively forming first and second polygons, each polygon with a fixed number ("N") of sides.

10. The printing machine of claim 9, N being 8.

11. The printing machine of claim 8, arranged for rotating the rotatable charging apparatus from a current charging device to the at least one apparatus surface devoid of a charging device facing the photosensitive element when a power-down condition exists.

12. The printing machine of claim 11, further arranged for rotating the rotatable charging apparatus from the current charging device to the at least one apparatus surface devoid of a charging device when a hard-stop condition exists.

13. A printing machine comprising a rotatable charging apparatus, the rotatable charging apparatus comprising an apparatus length extending between a first end and a second end and centered about an axis parallel to the apparatus length, with plural charging devices fixed to an apparatus periphery surrounding the axis, the rotatable charging apparatus rotatable about the axis to thereby selectively position any charging device to face a proximate photosensitive element, each charging device comprising a solid-state charger, arranged for rotating the rotatable charging apparatus from a current charging device to a new charging device facing the photosensitive element when a total number of hours of operation of the current charging device exceeds a fixed threshold.

14. The printing machine of claim 13, further arranged for rotating the rotatable charging apparatus from the current charging device to the new charging device when a problem exists with the current charging device.

* * * * *